US007284587B2

(12) United States Patent
Nien

(10) Patent No.: US 7,284,587 B2
(45) Date of Patent: Oct. 23, 2007

(54) BLIND STRUCTURE

(75) Inventor: Leslie Nien, Changhua Hsien (TW)

(73) Assignee: Solteam Electronics Co., Ltd., Taoyuan (TW)

( * ) Notice: Subject to any disclaimer, the term of this patent is extended or adjusted under 35 U.S.C. 154(b) by 145 days.

(21) Appl. No.: 10/989,333

(22) Filed: Nov. 17, 2004

(65) Prior Publication Data

US 2006/0048901 A1 Mar. 9, 2006

(30) Foreign Application Priority Data

Sep. 8, 2004 (TW) ..... 93214308 U

(51) Int. Cl.
*E06B 3/48* (2006.01)

(52) U.S. Cl. ..... 160/84.01

(58) Field of Classification Search ..... 160/84.01, 160/89, 84.05, 84.04, 84.03
See application file for complete search history.

(56) References Cited

U.S. PATENT DOCUMENTS

| | | | | |
|---|---|---|---|---|
| 6,354,353 | B1 * | 3/2002 | Green et al. | 160/84.04 |
| 7,111,659 | B2 * | 9/2006 | Harper et al. | 160/84.05 |
| 2004/0079492 | A1 * | 4/2004 | Lin | 160/84.01 |

* cited by examiner

*Primary Examiner*—David M. Purol
*Assistant Examiner*—Candace L. Bradford
(74) *Attorney, Agent, or Firm*—Troxell Law Office, PLLC

(57) ABSTRACT

An improved blind structure includes a Roman blind having a head-rail made up of a first and second engaging sections symmetrically extending at both top lateral sides thereof for a plurality of guide sliding seats to be respectively mounted thereto wherein a pull cord positioning seat and an actuation cord positioning seat are symmetrically joined at one end of the first and the second engaging sections thereof respectively, and a light-passable blind body is fixedly attached at the underside of the head-rail in alignment with the first engaging section thereof to be collected or expanded via pull cords. A plurality of black-out blind pieces are sequentially sewed in an equal space at one side of the light-passable blind body from top to bottom thereof, and at the bottom edges of the black-out blind pieces are detachably mounted a plurality of movable members that, each having a retaining through hole disposed thereon, are vertically lined up for actuation cords to sequentially thread there-through and tie up to each retaining through hole thereof respectively before winding around the actuation cord positioning seat to suspend downwards there-from. Therefore, the black-out blind pieces are raised upwards by the actuation cords towards one side of the head-rail to reveal the light-passable blind body in sections so that light can come partially indoors according to the position of the uplifted black-out blind pieces, efficiently boosting the function of the Roman blind thereof.

9 Claims, 6 Drawing Sheets

BLIND STRUCTURE

BACKGROUND OF THE INVENTION

The present invention is related to an improved blind structure, including a Roman blind made up of a light-passable blind body fixedly attached to one side at the bottom of a head-rail to be colleted or expanded by pull cords, and a plurality of black-out blind pieces sequentially fixed in an equal space at one side of the light-passable blind body from top to bottom thereof wherein at the bottom edges of the black-out blind pieces are detachably mounted a plurality of movable members with retaining through holes disposed thereon that are vertically lined up for actuation cords to sequentially thread there-through and tie up thereto respectively; whereby, the black-out blind pieces are raised upwards by the actuation cords towards one side of the head-rail to reveal the light-passable blind body in sections so that light can come partially indoors according to the position of the uplifted black-out blind pieces, efficiently boosting the function of the Roman blind thereof Please refer to FIG. 1. A conventional Roman blind structure is made up of a Roman blind 10 having a blind body 12 of a proper length and width that is securely fixed to the underside f a head-rail 11 wherein at the rear side of the blind body 12 thereof is sequentially sewed in an equal space a plurality of folding edges 12 each having retaining rings 122 riveted thereon in alignment with cord-passage holes of the head-rail 11 (without shown in the diagram), permitting pull cords 13 led through the inner side and the cord-passage holes of the head-rail 11 thereof to pass sequentially through each of the retaining rings 122 till fixedly tied up to the bottommost retaining rings 122 thereof. A pulley seat 14 is fixedly mounted at one end of the head-rail 11 therein for the pull cords 13 to wind there-through before suspending downwards there-from for a proper length at the front side of the blind body 12 thereof Therefore, the pull cords 13 are drawn to raise upwards the bottommost retaining rings 122 and sequentially lift the other retaining rings 122 from bottom to top therewith, permitting every two folding edges 121 of the blind body 12 to fold upwards and stack on one another so as to collect the blind body 12 suspending downwards in multiple layers.

There are some drawbacks to such conventional Roman blind structure. First, when drawn upwards by the pull cords 13 thereof, the blind body 12 of the Roman blind 10 is simply folded and collected to suspend downwards in multiple layers, which is rather monotonous in practical use. Second, when the Roman blind 10 is fully expanded in a black-out status, the blind body 12 thereof can be only used to screen sunlight without any partial light allowed to come there-through. Thus, the conventional Roman blind 10, unable to provide partial light effect or perspective views outside when fully expanded, is quite limited in function.

SUMMARY OF THE PRESENT INVENTION

It is, therefore, the primary purpose of the present invention to provide an improved blind structure, including a Roman blind made up of a light-passable blind body fixedly attached to one side at the bottom of a head-rail to be colleted or expanded by pull cords, and a plurality of black-out blind pieces equidistantly sewed at one side of the light-passable blind body from top to bottom wherein at the bottom edges of the black-out blind pieces are detachably mounted a plurality of movable members vertically lined up for actuation cords to sequentially thread there-through and tie up thereto respectively; whereby, the black-out blind pieces are raised upwards by the actuation cords towards one side of the head-rail to reveal the light-passable blind body in sections, permitting light to come partially indoors according to the position of the uplifted black-out blind pieces or views outside to be seen there-through. Thus, the Roman blind can not only be completely collected or expanded in a total black-out status, but can also be synchronically adjusted to provide partial light and partial black-out effects, efficiently boosting the function of the Roman blind thereof.

It is, therefore, the second purpose of the present invention to provide an improved blind structure wherein via the number of the actuation cords drawn upwards and the movable members or guide sliding seats of the head-rail that are detachably mounted and freely adjusted in positions, the black-out blind pieces can be flexibly lifted upwards in any angles, permitting the light-passable blind body to reveal versatile perspective spaces accordingly. Thus, the Roman blind can be variably operated to fit to the needs of different users so as to provide a more human-centered design and achieve the best using condition thereof.

DETAILED DESCRIPTION OF THE PREFERRED EMBODIMENTS

Figure 1:
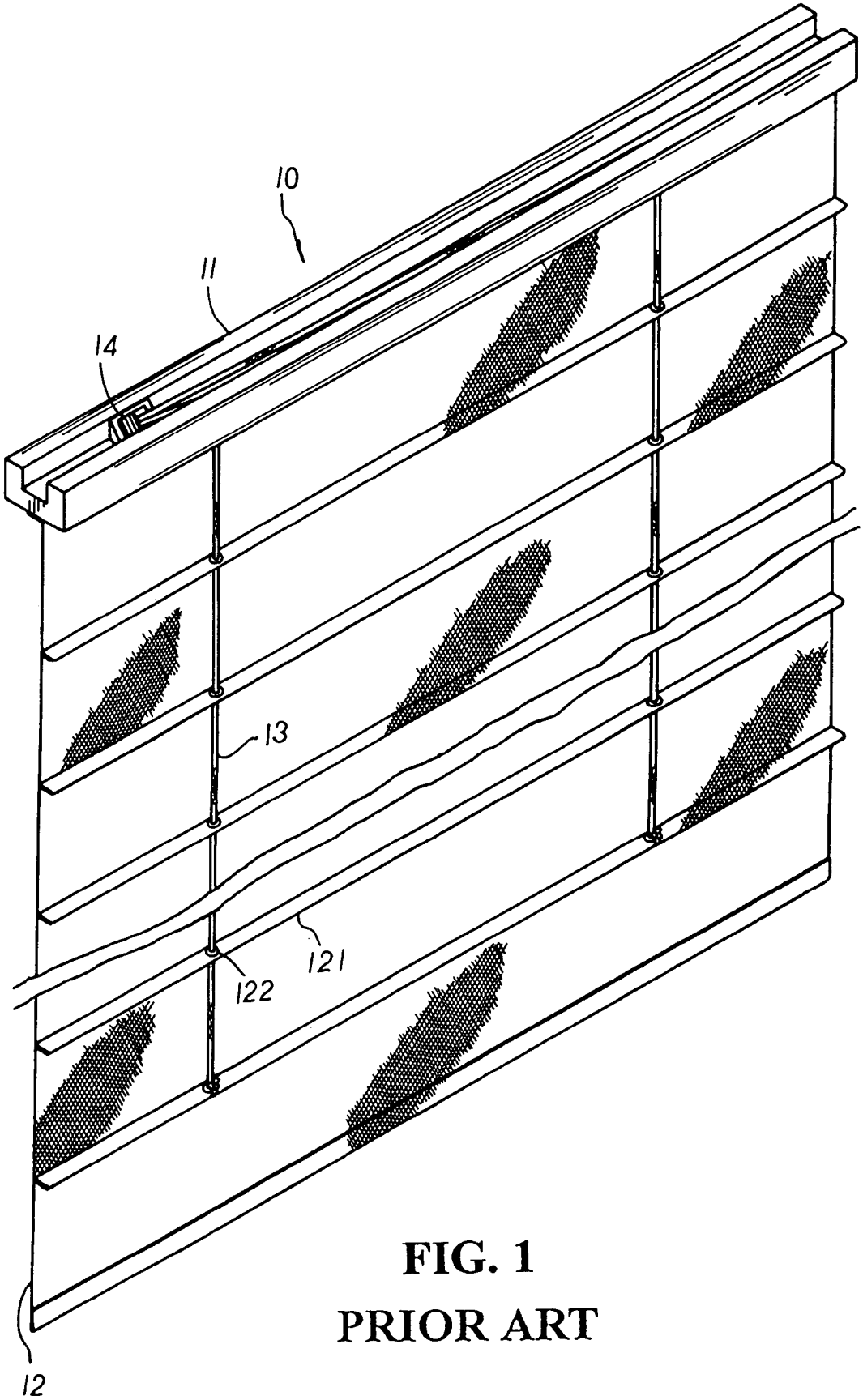
FIG. 1 PRIOR ART
FIG. 1 is a perspective view of a conventional Roman blind.
Figure 2:
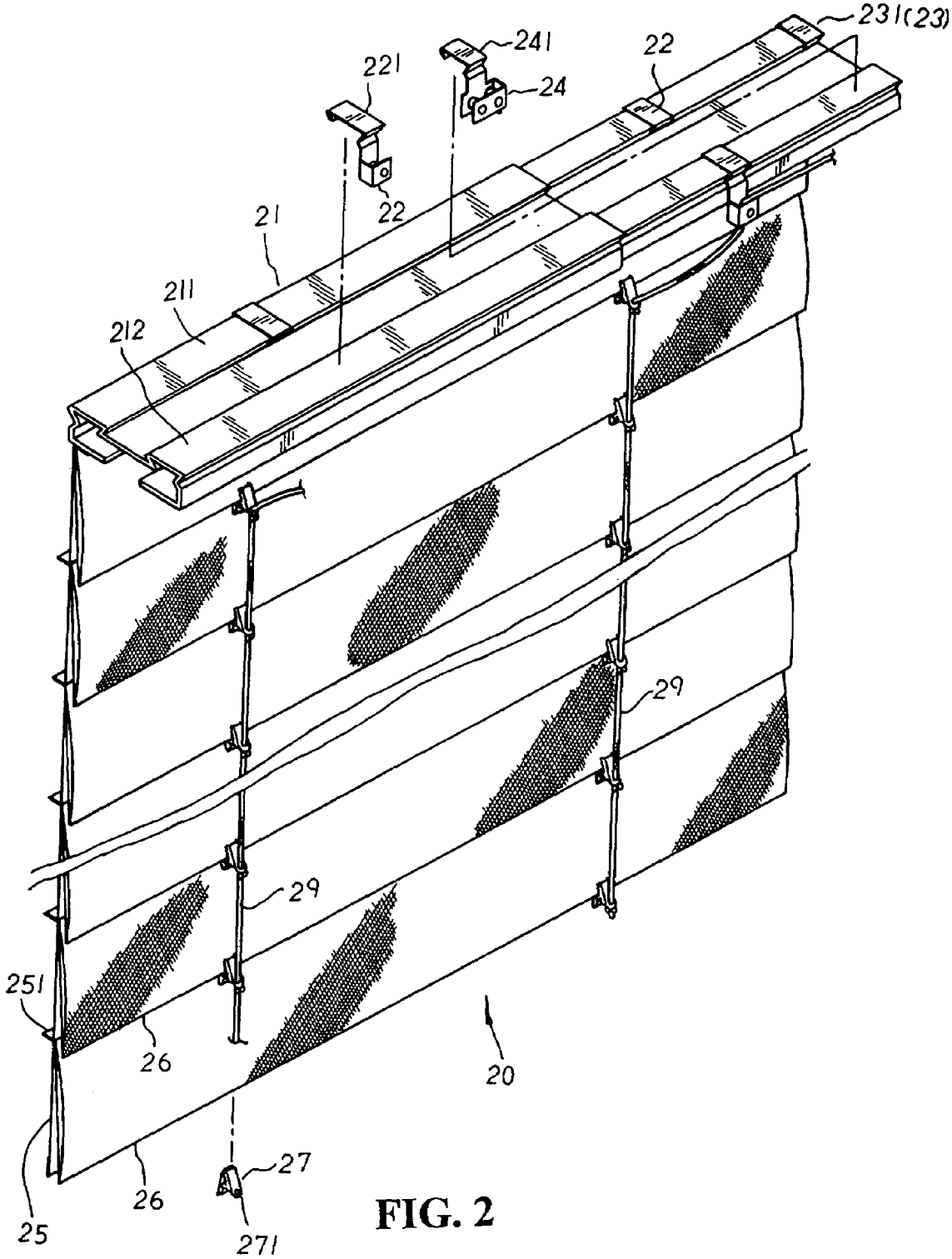
FIG. 2 is a perspective exploded view of the present invention.
Figure 3:
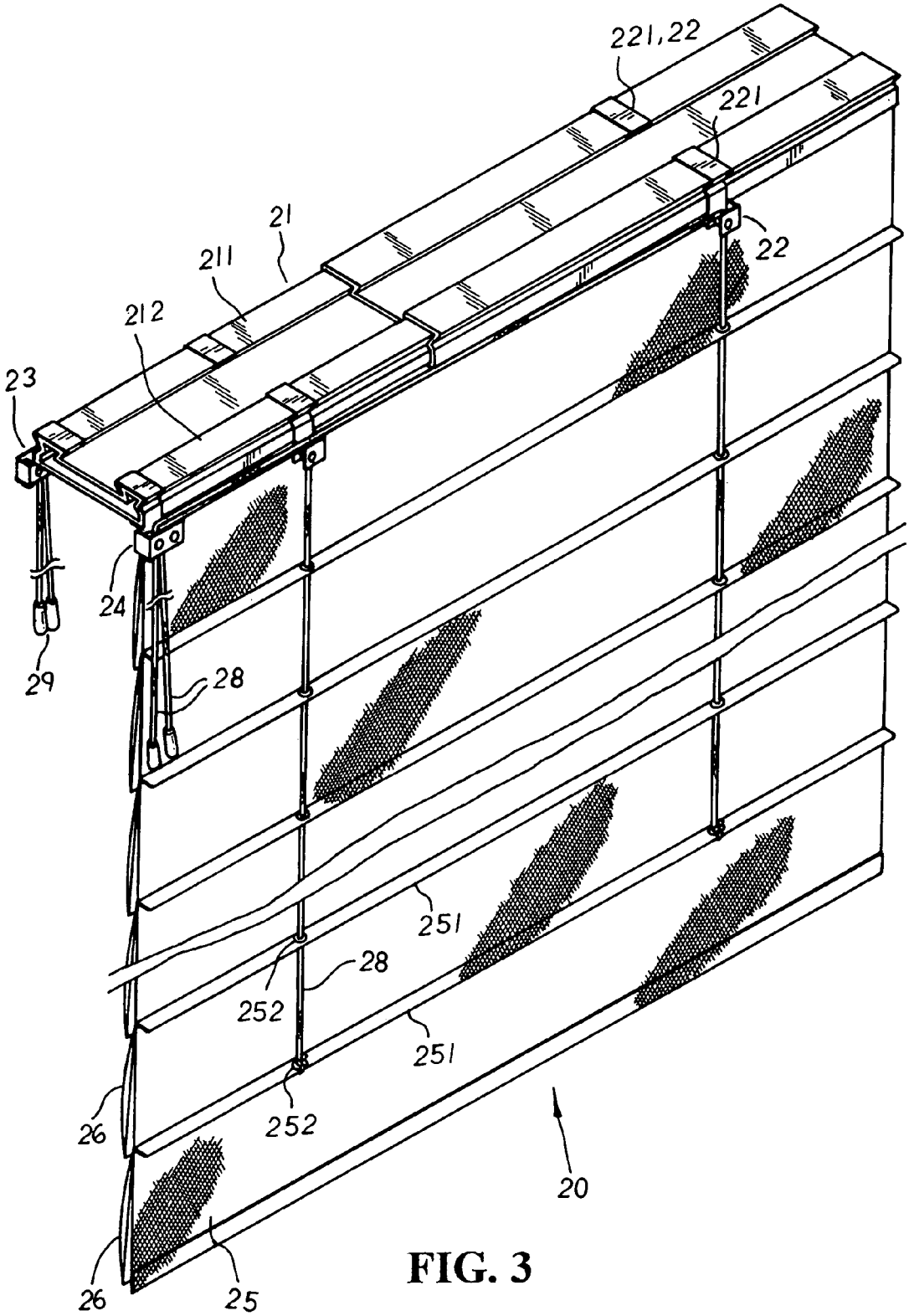
FIG. 3 is a rear side view of the present invention in assembly.
Figure 4:
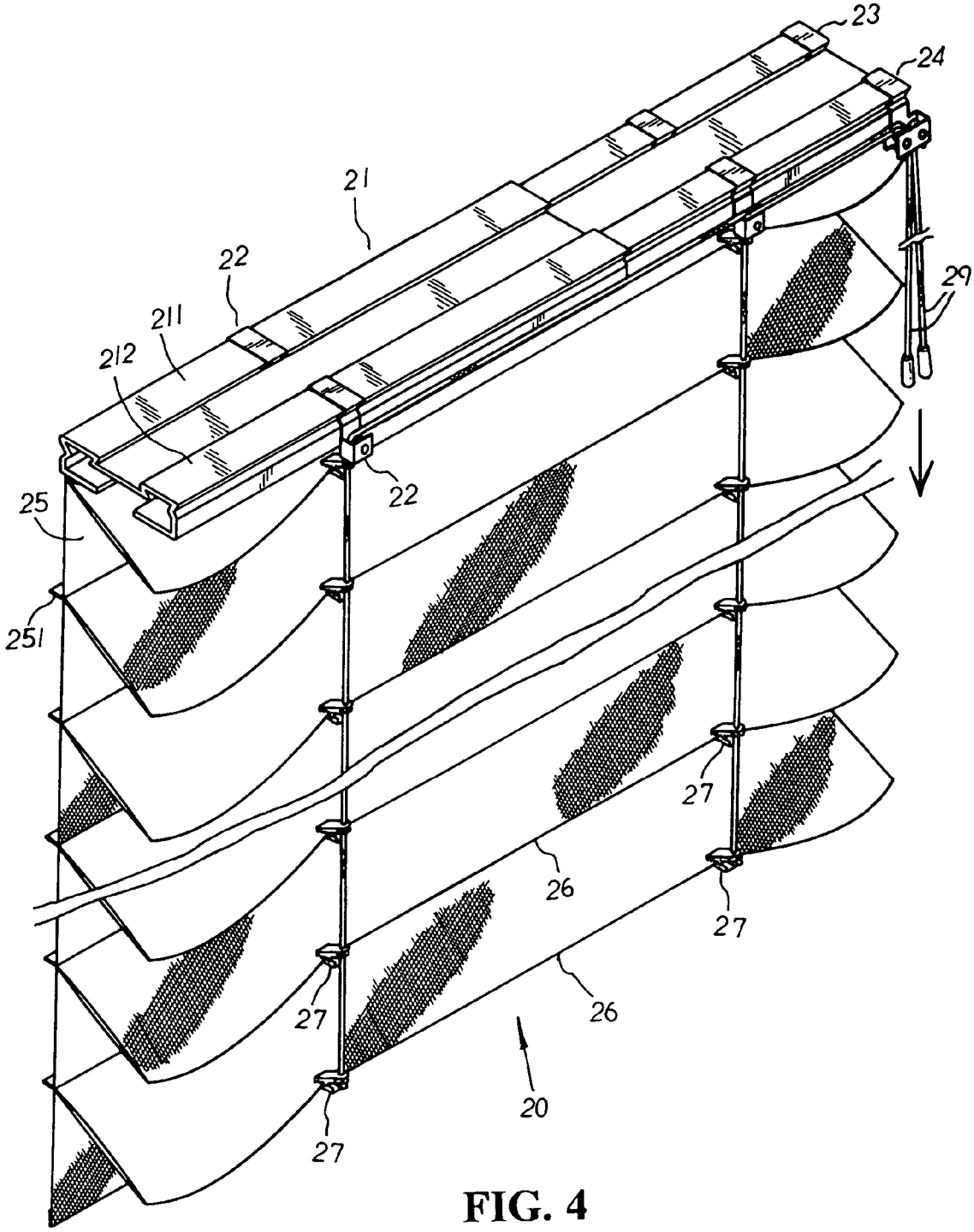
FIG. 4 is a diagram showing actuation cords of the present invention synchronically drawn in operation.
Figure 5:
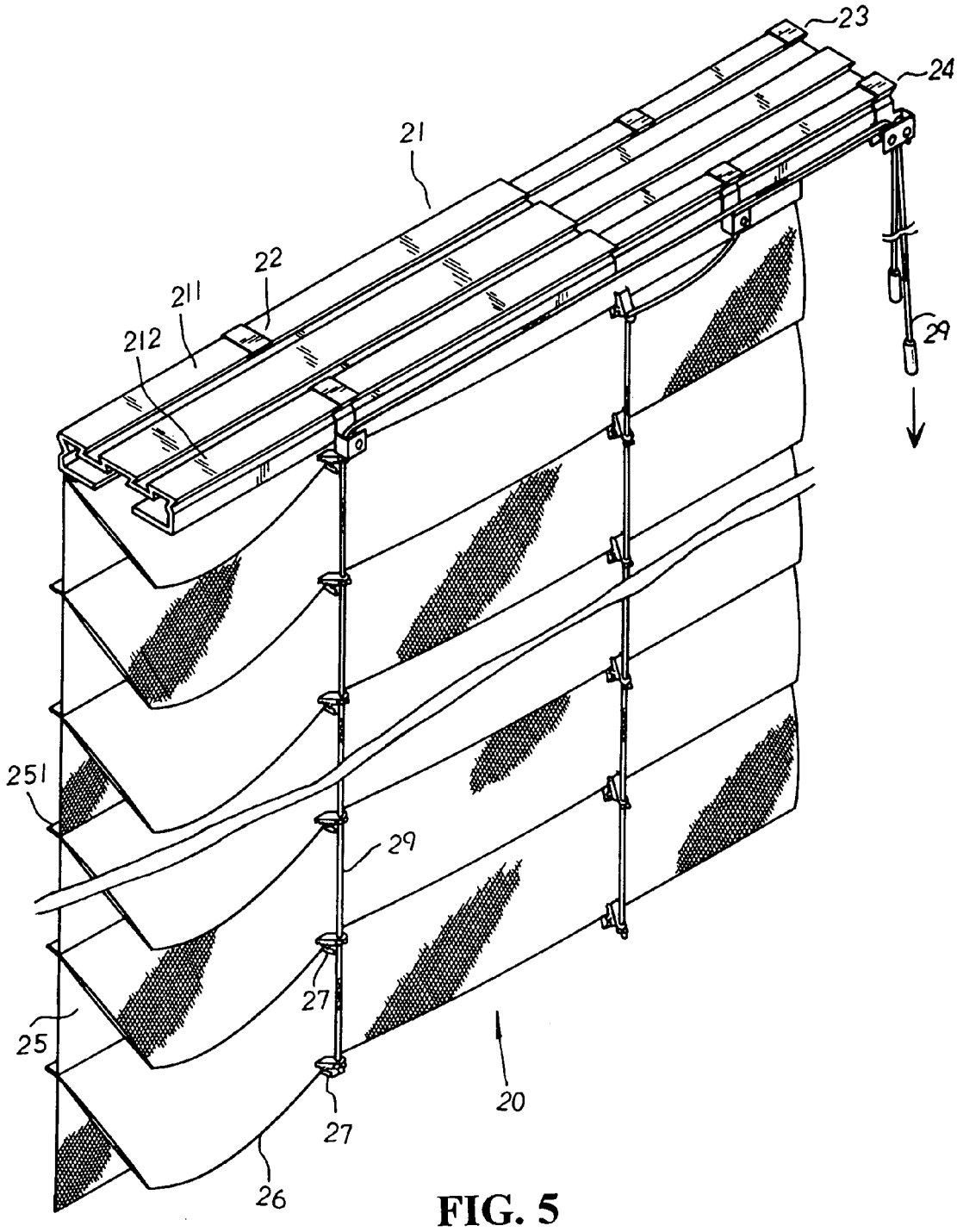
FIG. 5 is a diagram showing another embodiment of a head-rail of the present invention with a single actuation cord thereof individually drawn in operation.
Figure 6:
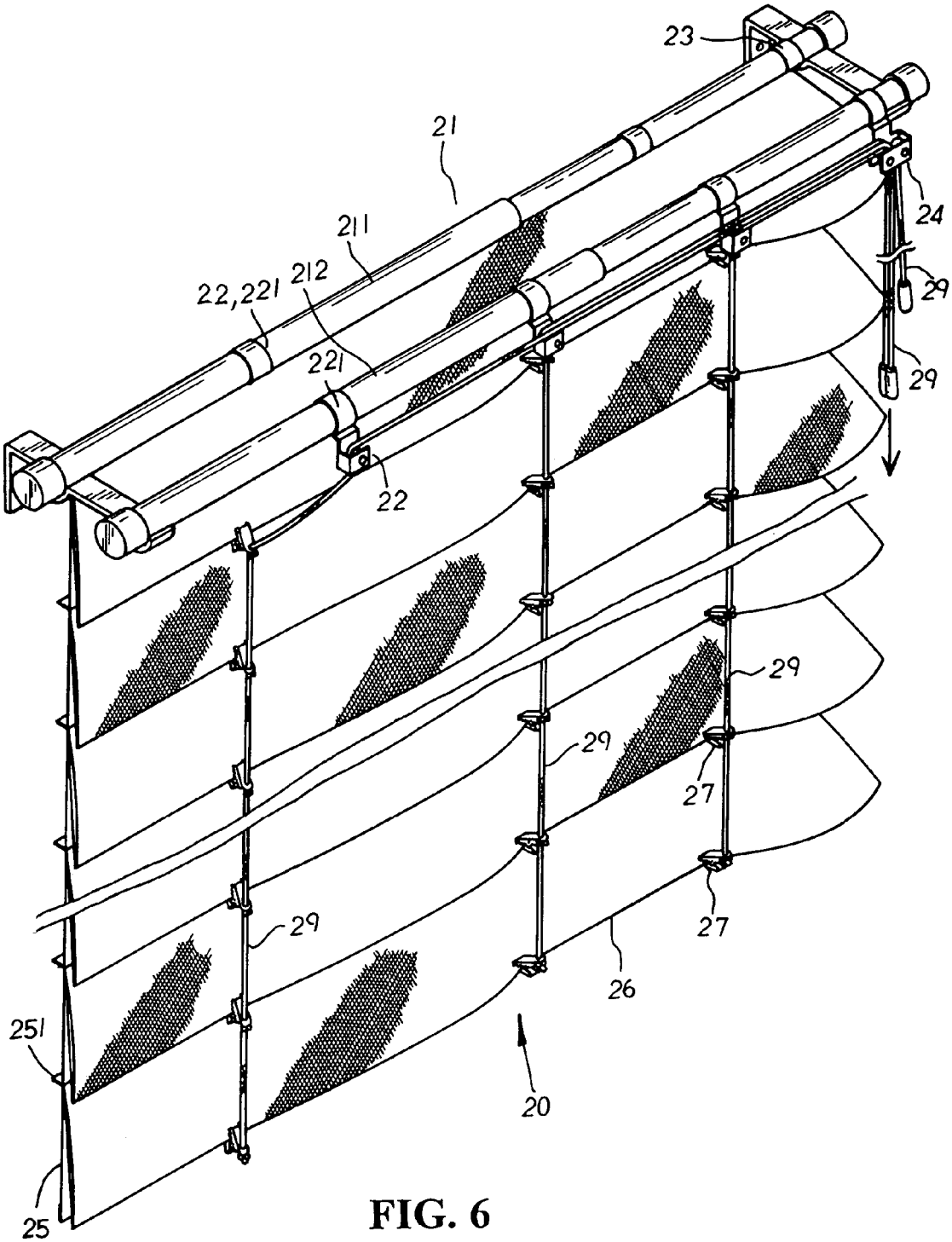
FIG. 6 is a diagram showing a third embodiment of the head-rail thereof with a single actuation cord individually drawn in operation.

Please refer to FIGS. 2 to 3 inclusive. The present invention is related to an improved blind structure, including a Roman blind 20 made up of a head-rail 21 having a first engaging section 211 and a second engaging section 212 symmetrically extending at both top lateral sides thereof for a plurality of guide sliding seats 22 each having a coupling part 221 to be mounted thereto respectively. A pull cord positioning seat 23 with a fixing part 231 and an actuation cord positioning seat 24 with a locating part 241 are symmetrically mounted at one end of the first and the second engaging sections 211, 212 thereof respectively. A light-passable blind body 25 is fixedly attached to the bottom side of the head rail 21 in alignment with the first engaging section 211 thereof, and at the rear side of the light-passable blind body 25 thereof are equidistantly sewed from top to bottom a plurality of folding edges 251 each having cord-passage rings 252 properly riveted thereon for pull cords 28 to thread there-through respectively in a sequence till securely fixed to the bottommost cord-passage rings 252 thereof At one seaming side of the folding edges 251 thereof are disposed a plurality of black-out blind pieces 26 each folded up into double layers to suspend downwards at the front side of the light-passable blind body 25 between every two folding edges 251 thereof. Otherwise, the black-out blind pieces 26 can also be equidistantly fixed in single pieces at one side of the light-passable blind body 25 thereof from top to bottom thereof At the bottom edges of the black-out blind pieces 26 are respectively equipped with two or more than two (as shown in FIG. 6) movable members 27 that, each having a retaining through hole 271 disposed thereon, are vertically lined up for actuation cords 29 to sequentially thread there-through and tie up to each retaining through hole 271 thereof respectively. The movable member 27 is preferably made in a flexible and easily detachable clip body. The pull cords 28 and each of the actuation cords 29 are respectively led through the guide sliding seats 22 mounted at the first and the second engaging sections 211, 212 thereof and wound around the pull cord positioning seat 23 and the actuation cord positioning seat 24 to hang downwards there-from individually. Thus, the pull cords 28 and the actuation cords 29 can symmetrically suspend downwards at the front and rear sides of the light-passable blind body 25 respectively as shown in FIG. 3. Besides, the first and the second engaging sections 211, 212 of the head-rail 21 thereof can be symmetrically spaced apart in shapes such as dovetailed bars (as shown in FIGS. 3, 4, 5) or elongated rods (as shown in FIG. 6) to mate with the coupling parts 221 of the guide sliding seats 22 as well as the fixing part 231 and the locating part 241 of the pull cord positioning seat 23 and the actuation cord positioning seat 24 thereof respectively.

In practical use, the pull cords 28 are drawn downwards to raise upwards the bottommost folding edge 251 of the light-passable blind body 25 and collect the other folding edges 251 sequentially from bottom to top therewith, permitting the pull cords 28 to move along the guide sliding seats 22 and pass downwards from the pull cord positioning seat 23 thereof. The light-passable blind body 25 lifted upwards by the pull cords 28 thereof is folded upwards at every two folding edges 251 and suspend downwards in multiple layers. Meanwhile, the black-out blind pieces 26 are sequentially stacked upwards side by side with one another along with the uplifted folding edges 251 thereof so as to completely collect the Roman blind 20 thereby. Besides, the actuation cords 29, respectively led and tied up to the retaining through holes 271 of the movable members 27 vertically aligned and attached to the black-out blind pieces 26 thereof, can also be synchronically drawn as shown in FIG. 4 or individually drawn as shown in FIGS. 5, 6 to move along the guide sliding seats 22 and pass downwards from the actuation cord positioning seat 24 thereof Meanwhile, the black-out blind pieces 26 are respectively raised upwards towards the second engaging section 212 accordingly, permitting the light-passable blind body 25 to reveal in sections through the uplifted black-out blind pieces 26 thereof so that light can come partially indoors according to the position of the raised black-out blind pieces 26, or views outside to be easily seen there-through. Thus, the Roman blind 20 can not only be completely collected or expanded in a total black-out status, but can also be synchronically adjusted to provide partial light and partial black-out effects. And via the number of the actuation cords 29 drawn upwards and the movable members 27 or the guide sliding seats 22 detachably mounted and freely adjusted in positions, the black-out blind pieces 26 can be flexibly lifted upwards in any angles, permitting the light-passable blind body 25 to reveal versatile perspective spaces accordingly. Thus, the Roman blind 20 can be variably operated to fit to the needs of different users and is efficiently boosted in function so as to provide a more human-centered design and achieve the best using condition thereof.

What is claimed is:

1. A blind comprising: a light-passable blind body fixedly attached to one side at a bottom of a head-rail to be actuated by pull cords, and a plurality of black-out pieces sequentially fixed in an equal space at one side of the light-passable blind body from top to bottom thereof wherein at the bottom edges of the black-out blind pieces are respectively equipped with two or more than two movable members that, each having a retaining through hole disposed thereon, are vertically lined up for actuation cords to sequentially thread there-through and tie up to each retaining through hole thereof respectively; a plurality of guide sliding seats are properly mounted at both top lateral sides of the head-rail respectively, and a pull cord positioning seat and an actuation cord positioning seat are symmetrically jointed at one end of the head-rail for the pull cords and the actuation cords led through the guide sliding seats disposed at both lateral sides of the head-rail to wind around respectively before hanging downwards there-from to suspend symmetrically at the front and rear sides of the light-passable blind body thereof; in practical use when the black-out blind pieces are raised upwards by the actuation cords towards one side of the head-rail, the light-passable blind body will be revealed in sections through the uplifted black-out blind pieces, permitting light to come partially indoors according to the position of the raised black-out blind pieces, or views outside to be easily seen there-through; the blind is adjustable between a plurality of positions selected from a group comprising completely collected, expanded in a total black-out status, synchronically adjusted to provide partial light, and synchronically adjusted to provide partial black-out effects; via the number of the actuation cords drawn upwards and the movable members or the guide sliding seats detachably mounted and freely adjusted in positions, the black-out blind pieces are flexibly lifted upwards to a plurality of angles.

2. The blind structure as claimed in claim 1 wherein the head-rail is equipped with a first and second engaging sections symmetrically extending at both top lateral sides thereof.

3. The blind structure as claimed in claim 2 wherein the first and the second engaging sections of the head-rail are symmetrically spaced apart in shapes selected from dovetailed bars and elongated rods.

4. The blind structure as claimed in claim 1 wherein the light-passable blind body thereof is correspondingly aligned with the first engaging section of the head-rail thereof.

5. The blind structure as claimed in claim 1 wherein the guide sliding seat, the pull cord positioning seat and the actuation cord positioning seat are respectively provided with coupling parts, an engaging part, and a locating part extending at one side thereof to be correspondingly mated with the first and the second engaging sections of the head-rail thereof.

6. The blind structure as claimed in claim 1 wherein each black-out blind piece thereof is folded up into double layers.

7. The blind structure as claimed in claim 6 wherein the black-out blind pieces are made in single nontransparent pieces and directly sewed in an equal space at one side of the light-passable blind body from top to bottom thereof.

8. The blind structure as claimed in claim 1 wherein the black-out blind pieces are made in single nontransparent pieces and directly sewed in an equal space at one side of the light-passable blind body from top to bottom thereof.

9. The blind structure as claimed in claim 1 wherein the movable member thereof is preferably made in a flexible clip body that is easily detached from the black-out blind piece thereof.

* * * * *